US006474461B1

(12) United States Patent
Grabovszky

(10) Patent No.: US 6,474,461 B1
(45) Date of Patent: Nov. 5, 2002

(54) APPARATUS FOR THE UPKEEP OF A MOBILE MAINTENANCE CARRIAGE OR A WORKSTATION OF A TEXTILE MACHINE

(75) Inventor: Gerhart Grabovszky, Lenting (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 95 days.

(21) Appl. No.: 09/606,262

(22) Filed: Jun. 29, 2000

(30) Foreign Application Priority Data

Jul. 2, 1999 (DE) ..... 199 30 644

(51) Int. Cl.[7] ..... D01H 9/10
(52) U.S. Cl. ..... 198/345.3; 57/268; 57/271
(58) Field of Search ..... 57/268–272; 104/264, 104/272; 198/345.3

(56) References Cited

U.S. PATENT DOCUMENTS

| | | | | |
|---|---|---|---|---|
| 4,133,168 A | | 1/1979 | Keller, Jr. et al. | |
| 4,159,620 A | * | 7/1979 | LaFlaquiere et al. | 57/301 |
| 4,840,022 A | * | 6/1989 | Karl et al. | 57/263 |
| 5,568,720 A | * | 10/1996 | Teich et al. | 57/281 |

OTHER PUBLICATIONS

German Patent Office Search Report, Oct. 4, 1999.

* cited by examiner

*Primary Examiner*—Christopher P. Ellis
*Assistant Examiner*—Mark A. Deuble
(74) *Attorney, Agent, or Firm*—Dority & Manning

(57) ABSTRACT

A maintenance carriage (2) of a textile machine (1) is comprised of a chassis (3) for travel along a plurality of like workstations (10) and a robot (4). The Robot is so placed on the chassis that it can be brought into an inspection position (I) from a service position (W) transverse to the travel direction of the chassis and subsequently returned too the service position. In its inspection position the robot creates a traversable passage (P) with a width which is at least 40 cm between the textile machine and itself. In its service position, the robot is secured in relation to the chassis with the aid of a locking mechanism. On each longitudinal machine side (A,B), the textile machine exhibits a separate running rail (14, 140) which possesses no connection with the running rail of the other longitudinal machine side and said running rail accommodates at least one maintenance carriage. The running rail is located above the longitudinal side area of the textile machine and the running rail exceeds the longitudinal stretch of the textile machine by at least the width of a maintenance carriage.

8 Claims, 4 Drawing Sheets

FIG.5
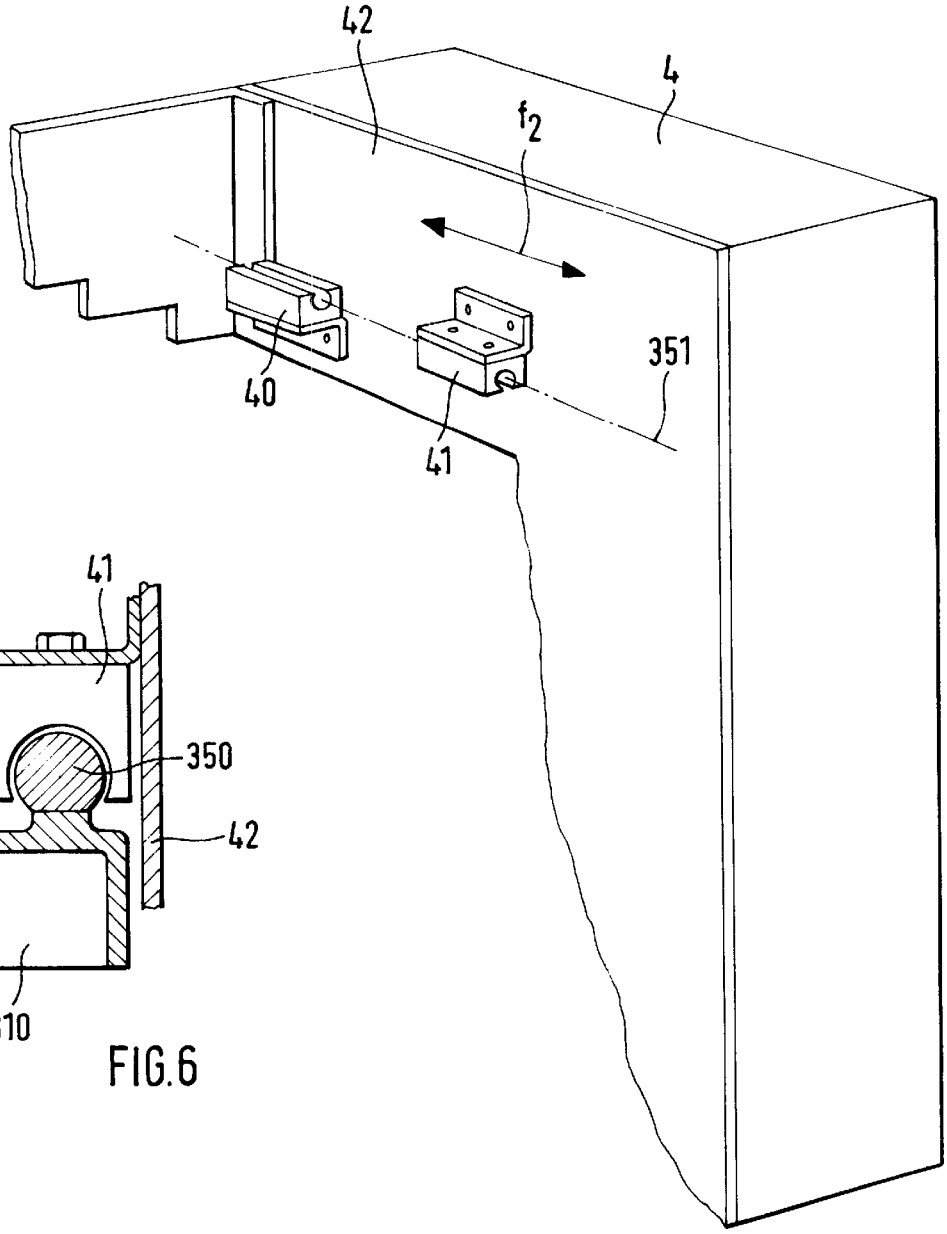
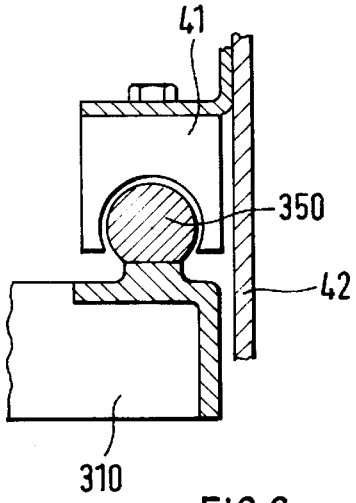
FIG.6

APPARATUS FOR THE UPKEEP OF A MOBILE MAINTENANCE CARRIAGE OR A WORKSTATION OF A TEXTILE MACHINE

BACKGROUND

Mobile maintenance carriages are installed for servicing the workstations of textile machines which possess a plurality of like workstations, these being spinning, thread, or spooling machines. The maintenance carriages require on their own inspections from time to time in order to uphold their functional ability. Furthermore, an inspection of a mobile maintenance carriage is a required matter, especially when repetitive operative failures occur, to restore the functional integrity of the carriage. For such remedial action, it is a known practice to run the maintenance carriage to the end of the textile machine where the running rail of a machine's longitudinal side is connected with the running rail of the other longitudinal side of the machine by a bowed rail. Since the bowed rail, because of its curvature, is set away from the textile machine the desired degree of accessibility to the mechanisms of the mobile maintenance carriage becomes available. At the same time, the accessibility to the workstations of the textile machine for the machine attendants is not obstructed by the maintenance carriage. However, the disadvantage lies therein that the upkeep work on the maintenance carriage is carried out at a distance from the workstations of the textile machine. This is especially troublesome if, as a result of wear at individual workstations, a particularly careful correction by the maintenance carriage is required. In such a case, the maintenance carriage must be moved back and forth between its own servicing position on the bowed rail and the workstation where attention is needed.

DE 36 02 961 A1 has already made known that the maintenance carriage, while it is still on the longitudinal running rail of the textile machine, can be brought into an inspection position transverse to its normal travel direction. To carry this out, a section of the running rail on which the maintenance carriage normally patrols along the side of the textile machine is made to be movable in a direction at right angles to its longitudinal course. This transversely movable section of the running rail is located at a definite point on either longitudinal side of the textile machine. Consequently, at this point the distance between the workstation to be serviced and the maintenance carriage is smaller than that in the case of a repair operation on the maintenance carriage at the bowed section of the running rail. In addition to this, as before, it is not possible to carry out a repair on the maintenance carriage close up to a chosen workstation.

SUMMARY OF THE INVENTION

Thus it is the purpose of the present invention to create an apparatus in accord with the generic type which will permit inspection and repair of the traveling maintenance carriage in the direct neighborhood of any chosen workstation. By this means, it will be possible to carry out in a time sparing manner, a common service for the workstation as well as the maintenance carriage, which enables an optimal accommodation of both the workstation and the maintenance carriage. Additional objects and advantages of the invention will be set forth in part in the following description, or may be learned through practice of the invention.

The above purpose is achieved by the features of an apparatus for the maintenance of a mobile maintenance carriage which travels over running rails along a plurality of like workstations of a textile machine which could provide service to one of these workstations. The maintenance carriage can be brought into an inspection position transverse to its travel direction, the maintenance carriage comprises a chassis for travel along the plurality of workstations as well as a robot which is so placed on the chassis that it can be moved relative to the chassis and transverse to the travel direction into the inspection position and be brought back therefrom. The purpose is also achieved by an apparatus where the robot in its inspection position creates between the textile machine and itself a traversable passage, the width of which measures at least 40 cm. Alternatively, the width of the passage can essentially measure 50 cm. By means of a separation of the maintenance carriage into a chassis, which always remains on the running rails, and into a characteristic robot with those mechanisms which are required for coactive services at the workstation, the robot can be removed far enough from the workstation, that first the area of the robot facing the workstation, and second the workstation both become accessible.

The mobility of the robot on its travel chassis can be achieved in different ways. For instance, this can be accomplished with the aid of an appropriate rod in order to create a compact, precise guidance and allow placement of the robot independently of its position relative to its chassis.

To do this, the maintenance carriage would be designed in accord with an apparatus where the chassis exhibits two guide rods for the robot which extend themselves transverse to the direction of travel of the chassis. Since movements of the maintenance carriage, that is, its robot, into a position transverse to the chassis are not expected to occur all too often, generally, a preferred development of the apparatus exists where the guide rods are part of a sliding guidance.

Advantageously, the object of the invention is further improved by means of an apparatus where the robot on its side and proximal to the textile machine seizes the guide rods of the chassis with the aid of guide pieces from the underside. This occurs while the robot on its side remote from the textile machine with the aid of guide pieces seats itself upon the top of the guide rods. Such a design assures, in a simple manner, a guidance of the robot stabilized against tipping over, even during a movement from close to the workstations into its repair location at a distance from the workstations, or also in the reverse movement.

If, because of technical developments, fully new principles of usage appear which call for a far reaching changed construction of the robot, then in accord with a design of the apparatus the robot is removably affixed on the chassis. An exchange of the robot suffices, so that the chassis can accept a new robot. The same applies, naturally, when a robot because of time consuming repair thereon is removed from its place on the textile machine and another already rehabilitated robot takes its place.

To secure the robot in its operational position near to the textile machine, it is advantageous if the robot in its service position is secured in relation to the chassis with the aid of a locking device. Preferably, the maintenance carriage is provided with a limit switch or the like for monitoring the faultless occupation of the service position and/or the inspection position of the robot. In a further embodiment of the object of the invention an apparatus by which each longitudinal side of the textile machine is assigned at least two like maintenance carriages is provided. Here, the limit switch of a maintenance carriage is connected to a central control which is programmed in such a manner that upon the removal of the robot of a maintenance carriage from its service position, at least one of the other maintenance carriages is assigned the released service stretch. This said limit switch can so act, by means of a central control apparatus, that upon the release of a portion of or all of an assigned service stretch by one maintenance carriage, another maintenance carriage can take over the service work to the textile machine work in the portion so released.

In order to permit the mechanisms of the robot to be subject to control, even when the robot takes up a repair position distant from the workstation, an improvement of the described apparatus is made. This being an apparatus where the chassis is connected with a first energy conducting cable to the textile machine and with the aid of a second energy conducting cable is connected to the robot. During the relative motion between the chassis and the robot, the supply connection between the chassis and the robot is held secure.

So that, during an upkeep operation on the maintenance carriage, the services on the other longitudinal side of the textile machine will not be put to disadvantage, the textile machine is advantageously constructed. This includes an apparatus where the textile machine on each longitudinal machine side possesses a plurality of like workstations as well as a separate running rail for at least one mobile, maintenance carriage comprised of a chassis and a robot. The service position for the maintenance carriage need no longer be in the arc of the curved portion of the running rails. This is because an embodiment exists where the running rails of the two longitudinal machine sides exhibit no connection between one another. The curved end piece of running rail may be dispensed with. For this situation, the design in accord with the invention of the described apparatus exists in an apparatus the running rails of a longitudinal machine side exceed the longitudinal side service stretch of a plurality of like workstations, at least on the one end by at least the width of a maintenance carriage. Since by an upkeep operation of lengthy duration on the maintenance carriage itself, this carriage may be removed from the longitudinal area of the textile machine, wherein a plurality of workstations are to be found, so that these workstations, during said duration, can be serviced by another maintenance carriage and hence are not left abandoned.

Since the running rails extend themselves along the entire textile machine side without transversely oriented sections, the chassis can be adjusted in a simple manner in reference to the running rails and accordingly also in regard to workstations. The robot travels in relation to the running rails in a predetermined movement, so that the position thereof in relation to the workstations is always occupied without fault. In the course of time, it can occur that because of wear, the mobile rollers working together with the running rails cause a change in the exact positioning of the of the robot. Remedial action becomes available advantageously through a design of the maintenance carriage in accord with an apparatus where the chassis to coact with the running rails possesses guidance and support rollers which are eccentrically mounted in bearings. This has its own individual importance, because a design of this kind is not only of advantage in combination with the above, but is also of value with maintenance apparatuses of different kinds, which do not possess robots separable from a chassis.

The apparatus in accord with the invention makes possible the upkeep of the maintenance carriage in the area of an optional workstation of the textile machine, wherein no changes in consideration of energy conservation or spool care of the textile machine become necessary.

Since robot upkeep at each optional position on the longitudinal side of the textile machine can be carried out, it is no longer a requirement that the two textile machine longitudinal sides need be bound together by the bowed running rail piece, which piece enabled the maintenance carriage to be brought into this curved zone for its own upkeep.

BRIEF DESCRIPTION OF THE DRAWINGS

Embodiments of the invention are provided in the following with more detailed description and explanations with the aid of the drawings. There is shown in.

DETAILED DESCRIPTION

Figure 1:
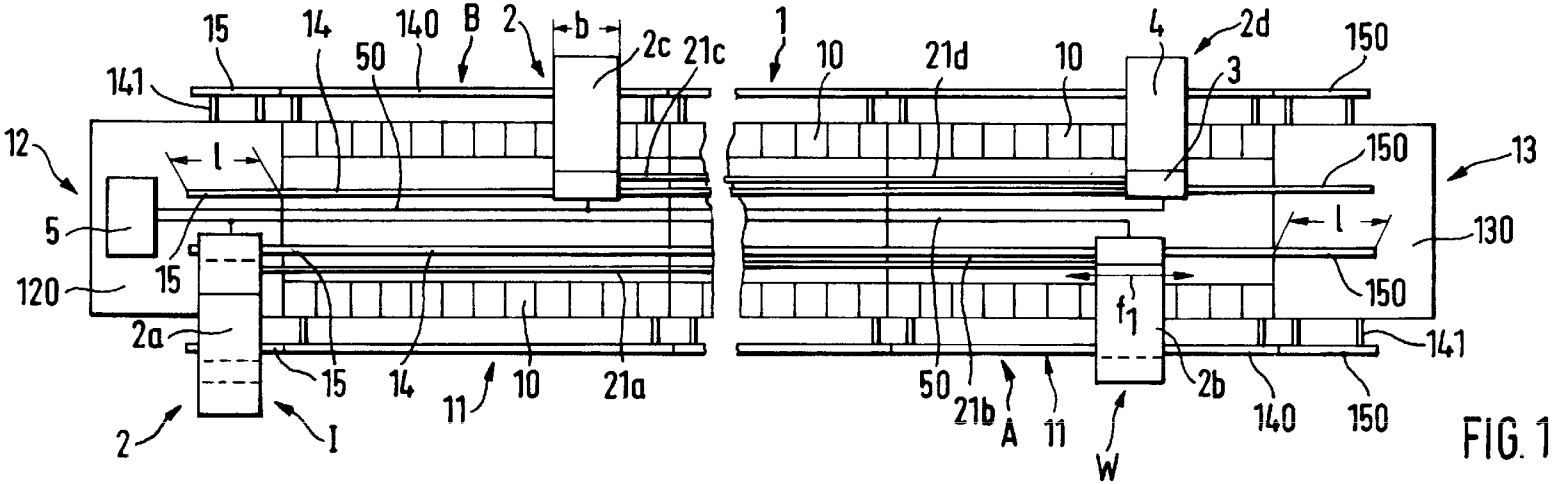
FIG. 1 a top view of a textile machine with a plurality of like workstations as well as four maintenance carriages in accord with the invention to patrol along the longitudinal sides of the textile machine, FIG. 2 in top view, a mobile maintenance carriage divided into a chassis and a robot, FIG. 3 in a perspective view, a maintenance carriage in accord with the invention, in its service position, FIG. 4 in a perspective view, the chassis of the invented maintenance carriage, FIG. 5 in a perspective view, a guidance arrangement for the invented robot of the maintenance carriage, and FIG. 6 a cross-section showing a detail of the guidance presented in FIG. 5

Reference will now be made in detail to one or more embodiments of the invention, examples of which are shown in the drawings. Each example is provided by way of explanation of the invention, and not meant as a limitation of the invention. For example, features illustrated or described as part of one embodiment can be used with another embodiment to yield still a third embodiment. It is intended that the present invention involve these and other modifications and variations as come within the scope and spirit of the invention.

FIG. 1 shows in a schematic top view a textile machine 1. The term textile machine can refer here to a spinning machine in the form of an open end spinning machine, a winding machine or a spinning machine of the conventional kind. Further reference by this name can be to a weaving machine or a spooling machine. Such textile machines 1 are normally of great length and, on this account, are subdivided into a plurality of similar machine sections 11. In accordance with the type of the textile machine 1, on one longitudinal side A of the machine, or as shown in FIG. 1 on both its longitudinal sides A and B, the textile machine possesses a plurality of like workstations 10.

These stations 10 are designed in accord with the type of the textile machine 1, that is, as spinning, weaving, spooling, or spinning/spooling workstations.

For the following description, essentially as an example, a textile machine of the type "open end spinning machine" has been chosen. This is for example only and this machine is not to be understood as a limiting factor in itself.

The textile machine possesses on both of its ends 12, 13 respectively an end structural frame work 120, 130, from which, respectively, as a rule one serves for the providing of energy and the other for acceptance of the drive.

Along the longitudinal side A and possibly B of the machine 1, a maintenance carriage 2 can travel which will be explained in detail later. For this purpose, the textile machine 1 possesses a first running rail 14 which extends itself longitudinally above the workstations 10 of the textile machine 1. In like manner, a second running rail 140 parallels the first. These rails 14, 140 are supported on the textile machine 1 by carriers 141 and are shown in reference to the operating side of the textile machine in front of the workstations 10, but at such a height that they do not impair access to the workstation 10 for the machine attendant. The special arrangement of these two running rails 14, 140 is however for the described apparatus of no relevance, and they can be integrated in the most different manners to current conditions.

Figure 3:
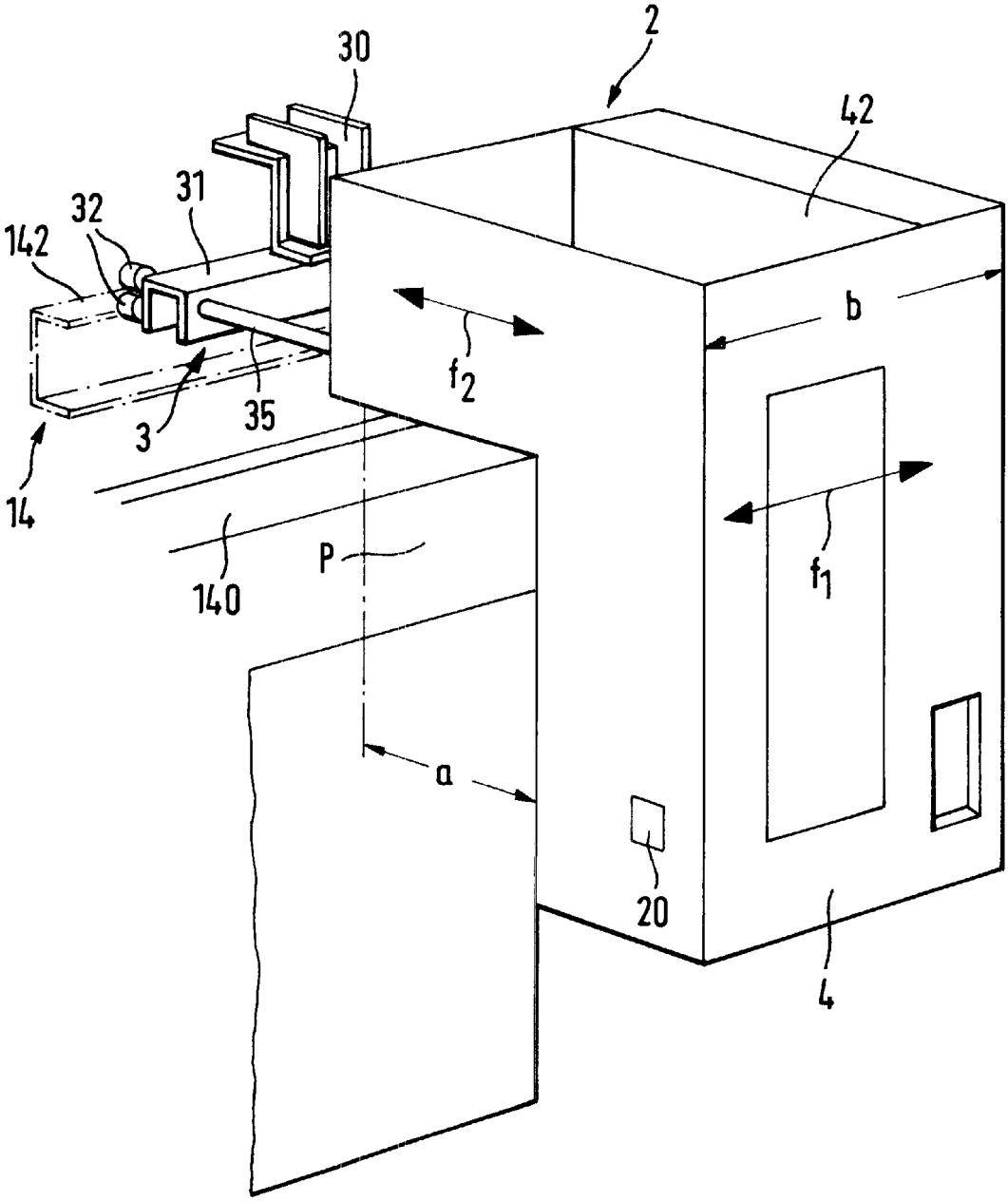
Figure 4:
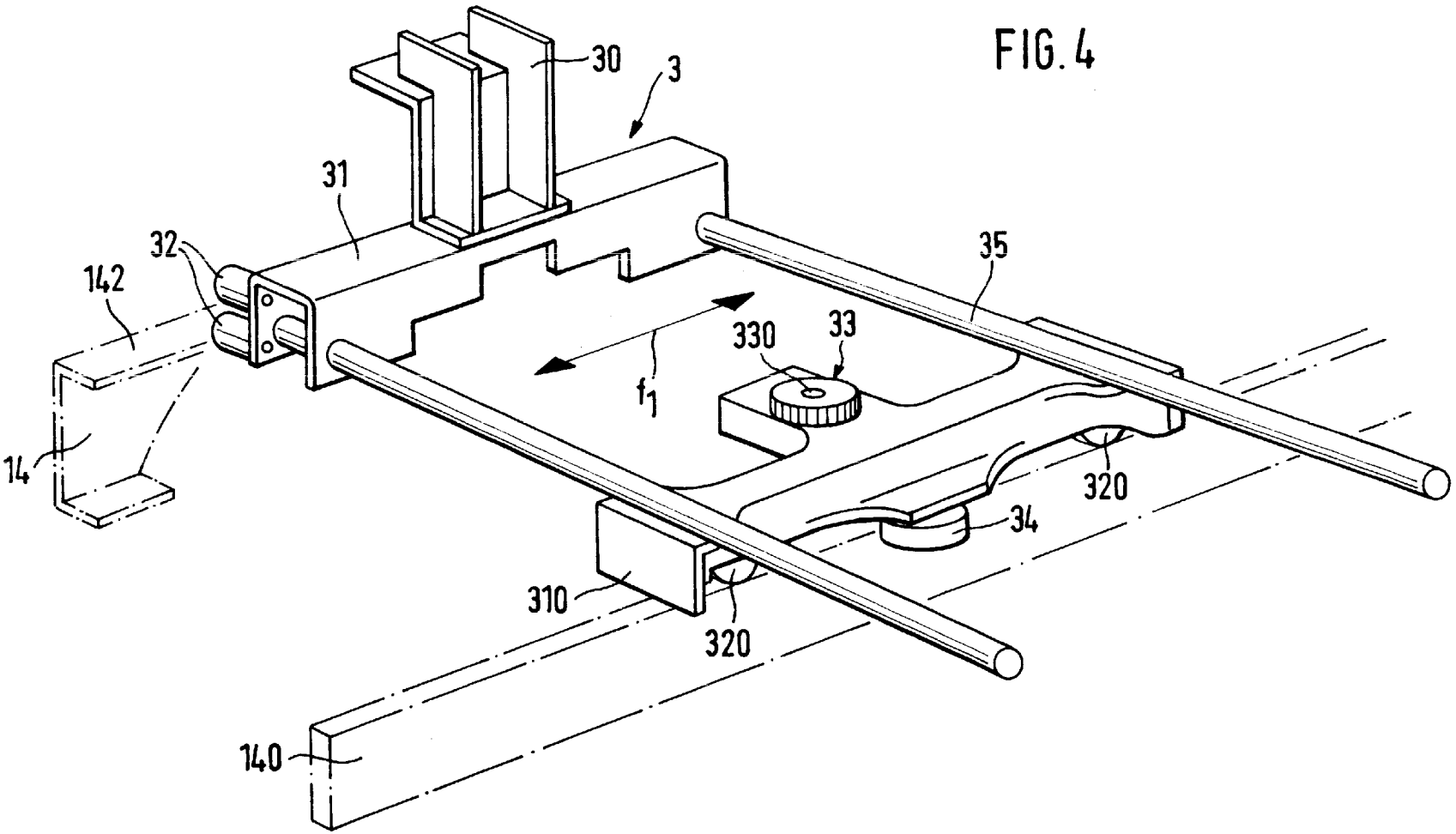

The maintenance carriage 2, serving a textile machine 1 designed as an open end spinning machine, must fulfill several purposes. These purposes include, for instance, a spin-start after a spool exchange or after a thread break. Another task would be the removal of a full spool and then the re-equipping of the workstation 10 with an empty spool. The said carriage 2 possesses a mobile chassis 3 (FIGS. 3 and 4) onto which the appropriate robot is mounted, which is placed on the said chassis 3 transversely to direction of travel $f_1$ thereof (see FIG. 1). The slidable mounting of the robot is in the direction of the double arrow $f_2$. The maintenance carriage 2 is thus essentially a two part assembly which will be described in more detail later.

The maintenance carriage 2 by means of its traveling chassis 3 can be run along the textile machine 1 and by a plurality of workstations 10. In this way, the robot 4 if needed at a specific station can be brought directly to this station. Which and how many workstations 10 a maintenance carriage 2 will be assigned to can be determined in the conventional manner.

The maintenance carriage 2, which comprises the chassis 3 and the robot 4, supports itself on the two running rails 14 and 140. During its patrolling along the textile machine 1 (travel direction $f_1$), the carriage 2 interrogates each individual workstation 10 as to whether or not its function is being executed faultlessly, that is, for instance as to the wind-up condition of the spool or the like. This can be carried out directly by data exchange with the respective workstation 10 or indirectly with the interposing of a central control apparatus 5 to which control apparatus the maintenance carriage 2 is conventionally connected by data or control lines 50.

If the components of an interrogated workstation 10 are not functioning without fault, or the spool has reached its specified tolerance regarding the degree of winding, then the maintenance carriage 2 remains standing at that workstation 10 and there carries out its necessary service procedures. This operation can involve several functions, which are individually carried out in accord with the type of the textile machine 1 and the phase of the work, all executed singly and independently of one another, or possibly in a required direct sequence. For instance, in a conventional manner a full spool is removed from a spooling device (not shown) and replaced by an empty spool, which action would be followed by a repeated spin-start operation.

Occasionally, an erroneous function cannot be rectified by the robot 4 even after several sequential efforts so that the attendant of the textile machine 1 must make the correction. This is the situation wherein the invention is to render support.

On its side remote from the textile machine 1, that is away from its service side, the robot 4 is normally well enclosed in order to avoid danger of injury by the mechanisms of robot 4 which mechanisms are to coact with those of a workstation 10.

These mechanisms of the robot 4 are, however, only accessible from that side of the robot 4 proximal to the textile machine 1.

In the case of the design of a maintenance carriage 2 up to this time, achieving access to these said mechanisms was possible only by running the said carriage into an end area of the textile machine 1 where the running rails 14 and 140 of the two textile machine 1 sides connected themselves together by a curved portion (not shown) of the said rails.

Contrary to this arrangement, with the two-part construction of the maintenance carriage 2, as a rule, these carriages remain in place where they are. Essentially, the robot 4 will be so pushed, relative to the chassis 3 of the maintenance carriage 2, into an inspection position that it finds itself distanced from the textile machine 1 and specifically from the workstation 10 before which it stands (see the double arrow $f_2$ in FIG. 2). There is at once a limited advantage gained, if the robot 4 is made movable in relation to the chassis 3 since in many cases accessibility to the internal mechanism is already sufficient even where the attendant cannot entirely gain a position exactly in front of the side of the robot 4 facing the textile machine 1.

The accessibility to these internal mechanisms of the robot 4 is, however, still more improved if the maintenance carriage 2 is so designed that a personal entry passage P (FIG. 2) is created by means of the bringing of the robot 4 into its inspection position I (double arrow $f_2$) between that side of the textile machine 1 proximal to the maintenance carriage 2 and that robot 4 side proximal to the textile machine 1 when the robot is in its inspection position I. This passage P should not be too confined, so that the attendant concerned with the upkeep on the robot 4 is provided with ample freedom of motion. Otherwise, the passage P must not be too large, so that the connection and guide elements between the chassis 3 and the robot 4 need not be constructed too heavily. Experience has shown, that the passage P formed between the textile machine 1 and the robot 4 should have a free width of at least 40 cm (see FIG. 3).

Advantageously, the dimension of this width of the passage P should, however, lie in the area of about 50 cm since in this way sufficient space is allowed for the attendant both for turning and off-angle motions, that is twisting or bending the body. Furthermore, this said width of the passage P enables the attendant to completely turn around, in order, if necessary, to carry out both an inspection and maintenance on the workstation 10 before which the robot 4 is at the time located as well as to provide the same services for the robot 4.

Because of the possibility of removing the robot 4 from the textile machine 1 by the formation of a passage P, the up to now common, machine-end curved section (not shown) to inspect the maintenance carriage 2 is no longer necessary so that the running rails 14 and 140 of the two machine sides A and B, also need to show any connection with one another. The previously needed curved section can accordingly be dispensed with unless other reasons show that at least one such curved section is of advantage.

Before further details in connection with the special design of the maintenance carriage 2 are gone into, FIG. 1 should be further examined. In accord with this Figure on each longitudinal side of the machine, i.e. A and B, respectively two maintenance carriages 2*a* and 2*b*, or 2*c* and 2*d* are provided. Respectively again, the two maintenance carriages 2*a* and 2*b* and/or 2*c* and 2*d*, of a longitudinal machine side A or B divide the work of that side assigned to them, whereby, as a rule the service stretches of these two maintenance carriages 2*a* and 2*b* or 2*c* and 2*d* are not restrictively determined but can overlap.

If the internal mechanisms of a maintenance carriage 2, namely the robot 4, for instance, of the maintenance carriage 2*a* is distanced by being pushed away or drawn away from the textile machine 1, then the other maintenance carriage 2*b,* or indeed, the other maintenance carriages 2 . . . of the longitudinal side A or B of the textile machine 1 extend themselves over a greater service stretch coverage.

Principally, this can occur because each maintenance carriage 2*a,* 2*b,* 2*c,* 2*d* possesses a sensor 20 (FIG. 2) which detects any difficulty in its travel track and upon the emergence of such a difficulty, a reversal of its direction $f_1$ of travel is activated. In this way, for instance, the maintenance carriage 2*b* upon the removal of, for instance, carriage 2*a* can then move unrestricted into the domain of the carriage 2*a,* which carriage has been deactivated by the removal of its robot 4 away from the normal service track. Advantageously, this is done without the necessity of additional programming.

At the end of the running rail 14 or 140, is provided either an appropriate limit switch (not shown) or, the maintenance carriages 2*a,* 2*b,* 2*c,* 2*d* are in communication with a (not shown) counting device which determines by counting when the maintenance carriage 2*a,* 2*b,* 2*c,* 2*d* has respectively reached the end of its maintenance area at the end of the running rails 14 and 140, and then must reverse travel.

In accord with FIG. 1, the running rails 14 and 140 of each longitudinal machine side A or B are extended beyond the section 11 of the textile machine 1 into the area of one of the two end structures 120 and 130. The running rail extensions on each longitudinal machines side A and B on the end 12 of the textile machine 1, have respectively a length 1 (small L), which at least corresponds to the width b of the maintenance carriage 2*a,* 2*b,* or 2*c,* 2*d* so that the maintenance carriage 2*a,* 2*b,* or 2*c,* 2*d* can fully remove itself from the longitudinal zone of the section 11. This is of value, should at some time a maintenance operation or inspection on the maintenance carriage 2*a,* 2*b,* or 2*c,* 2*d* require a longer period than usual.

So that each pair of maintenance carriages 2*a,* 2*b,* or 2*c,* 2*d,* can be brought to a point outside of the longitudinal stretch of the section 11, without detriment to the function of the other such a pair of maintenance carriages 2*a,* 2*b,* or 2*c,* 2*d,* in accord with FIG. 1, besides the running rail extension 15 on the one end 12 of the textile machine 1, an additional running rail extension 150 is provided at the other end 13 of length 1 (small L) which is equal in length to the running rail extension 15. The said extensions, of course refer to both rails 14 and 140.

Should the repair operation on a maintenance carriage, for instance maintenance carriage 2*a,* not be accomplished within a short time, then there is no point in carrying out this repair in front of a specific workstation 10. In this case it is advantageous if this maintenance carriage 2*a* releases the longitudinal zone of the textile machine 1 along the section 11, so that during the repair on this maintenance carriage 2*a,* the other or one other maintenance carriage 2*b,* 2*c,* or 2*d* can pick up the workstation service duty of that maintenance carriage 2*a* which has been taken out of the longitudinal section zone 11.

Figure 2:
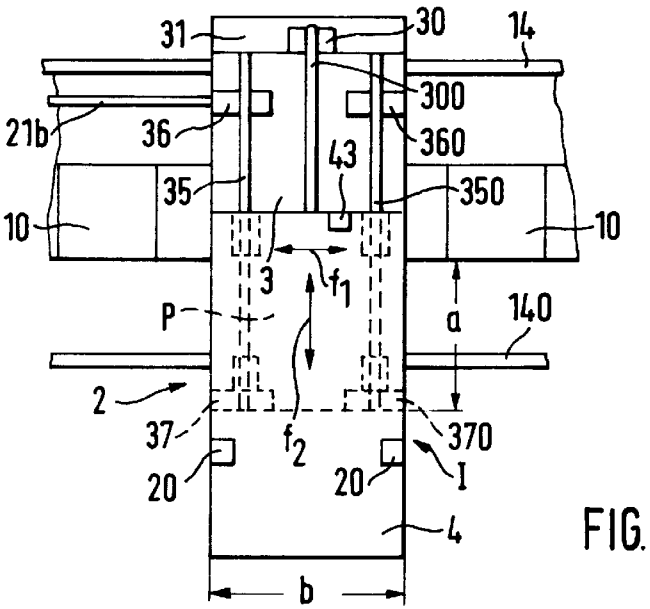

As a comparison of the maintenance carriages 2*a* and 2*b* (FIG. 1) shows, the robot 4 of the maintenance carriage 2*a* takes up its inspection position I, which position it assumes to form a personally traversable passage P to the textile machine 1 at an increased distance therefrom (see width b of the passage P in FIG. 2). At the same time, the robot 4 of the maintenance carriage 2*b* is to be found in its normal operational or functional position W near a workstation 10 in which it can carry out the customary services in the workstations of its assigned longitudinal stretch of activity.

Independent of which position a maintenance carriage 2*a,* 2*b,* 2*c,* 2*d* assumes it remains constantly in connection with a machine-side source of energy (not shown). For this purpose for each maintenance carriage 2*a,* 2*b,* 2*c,* 2*d,* respectively an energy carrier line 21*a,* 21*b,* 21*c,* 21*d* is provided which is so designed that during the movement of the maintenance carriage 2*a,* 2*b,* 2*c,* 2*d,* each in its travel direction $f_1$ in a conventional manner a reserve loop (not shown) is built up or dismantled. For this purpose, the energy carrier line, 21*a,* 21*b,* 21*c,* 21*d* . . . need not be construed in the narrow sense of the word "line", but refers to a loop and/or a cable (or the like) wherein the conductor takes over the established energy supply line and/or supports this. Furthermore, such an energy carrier 21*a,* 21*b,* 21*c,* 21*d,* can incorporate also data transmission or control lines 50, i.e. a bus system (see FIG. 1). This said carrier connects the maintenance carriage 2*a,* 2*b,* 2*c,* 2*d* . . . with the control center 5. In FIG. 1 these control lines 50 are presented (for the sake of clarity of the drawing) independently of the energy carrier lines 21*a,* 21*b,* 21*c,* 21*d* . . .

A further "energy carrier line" 200 (FIG. 2) serves for the connection between chassis 3 and robot 4. This comprises, like the previously mentioned energy carrier line 21*a,* 21*b,* 21*c,* 21*d* . . . a loop, a cable, etc. The chassis 3 possesses a retainer 30 (FIGS. 3 and 4) which serves for the take-off and the carrying of this additional energy carrier line 300, and which is so constructed that this energy carrier line 300 dependent upon the relative position of the robot 4 in relation to the chassis 3 can pick up a reserve loop (not shown).

The previously described design has the advantage that the robot 4 can remain continually in connection with the machine-side energy source independently of its relative position on the chassis 3. This makes it possible to let the robot 4 be run for testing purposes while still in its assigned position. This is especially to be desired if in the case of difficult operational conditions a fine adjustment must be undertaken on the robot 4 in its position facing an assigned workstation 10. In this way, the robot 4 after a phase of adjustment while it is out of its inspection position I, can be quickly brought into its maintenance position W. This is accomplished by moving the robot 4 relative to the chassis 3, that is without travel along the textile machine 1 so that a check can be carried out as to whether or not the maintenance carriage 2 now operates without fault or requires additional adjustment work.

In case it is necessary, this adjustment and monitoring of the faultless function can be connected with repetitive movements of the Robot 4 in the directions of the double arrow $f_2$, i.e. into its inspection position I and back into its service position (W).

Even when the energy connection between the chassis 3 and the robot 4 must be interrupted in the case of another embodiment of the maintenance carriage 2 during the time in which the robot 4 is located in its inspection position or position I, there remains the favorable accessibility of the mechanisms of the robot 4 without the obligation of sending the maintenance carriage 2 to the end of the textile machine.

The mentioned retainer 30 is borne by a first carrier 31 (FIG. 4) which in turn is movably carried by two pair of support rollers 3, which run on the running rail 14. In accord with the design shown in FIGS. 3 and 4, the running rail 14 is a structural channel bar, the upper horizontal flange 142 of which coacts with support rollers 32 which are on horizontal axles (axles not shown) and the flange 142 locates itself between the rollers 32. The running rail 14 with its flange 142 serves in this way for the vertical guide of the chassis 3.

The chassis 3 possesses a second carrier 310 (FIG. 4) which, like the above, carries support rollers 320 which in the depicted example are in turn supported upon the upper side of the running rail 140 designed as a flat bar.

Further the carrier 310 carries a drive motor (not shown) which, with the interposing of a (not shown) drive chain, or the like, is engaged with a pinion drive gear 33 the axle 330 of which carries on its other end a (not shown) friction wheel or the like. This friction wheel lies firmly on, relative to the plane of the drawing, that side of the running rail 140 remote from the observer. An elastic pressure apparatus (not shown) is assigned to this component comprised of the pinion drive gear and the friction wheel. On the side of the running rail 140 remote from the friction wheel (not shown) there is to be found an adjustable guide roller which the help of which the chassis can be adjusted in a horizontal direction in reference to the textile machine.

The axles of the support rollers 32 and 320 are not shown in the illustrations and principally can be constructed in an optional manner with bearings and are positionally adjustable. Since the support rollers 32 and 320, however, are heavily loaded because of their continual running duty and thus suffer also a high level of abrasive wear these support rollers 32 and 320 (and/or the guide roller 34) can be carried in eccentric bearings (not shown) so that their placement of the chassis 3 vertically as well as horizontally can be compensated for in accord with any such wear.

The eccentrical bearing placement of the support rollers 32 and 320 and/or the guide roller 34 or other rollers of this type (not shown) permits in a particularly simple way the adjustment of the same and thus is of use not only by a two-part maintenance carriage of the described kind, but also in the case of classic, single-unit maintenance carriages independent of the kind or arrangement of the running rails 14, 140 and with their coacting rollers.

The chassis 3 possesses a pair of guide rods 35 and 350 which lie transverse to running rails 14, 140 and are thus also transverse to the direction of travel $f_1$, and by means of which said guide rods (35, 350) the first and second carriers are bound together. These guide rods 35 and 350 serve for the guidance of the robot movement relative to the chassis 3. In accord with FIG. 5, the robot 4 carries as engaging elements which coact with these guide rods 35 and 350 the first guide piece 40 on the robot side and proximal to the textile machine 1, as well as the guide piece 41 on the side of the robot but remote from the textile machine 1. The first guide piece 40 engages the guide rod 35 or 350 from below and the second guide piece 41 engages the guide rod 35 or 350 from above. For clarification see FIG. 6.

In accord with FIGS. 5 and 6, the robot 4 possesses a vertical wall 42 on which the two guide pieces 40, 41 described above are respectively fastened to one of the guide rods 35 or 350. In FIG. 5, principally one guide piece 40 and one guide piece 41 are depicted which coact with the guide rod 350, which in FIG. 5 is represented by its centerline, yet it is self evident that similar guide pieces 40 and 41 are provided to serve for coaction with the other guide rod 35.

In a case wherein, because of space requirements, no wall such as wall 42 can be provided, naturally an element of another design for instance in the form of a support rail (not shown) can be substituted instead principally for the holding of the two guide pieces 40 and 41 of one of the two guide rods 35 and 350, or for one of these two guide pieces 40 or 41 of a guide rod 35 or 350, or for both guide rods 35 and 350.

The described type and method of the movability of the robot 4 with the aid of guide pieces 40, 41 is particularly advantageous in consideration of an exact positioning of the robot 4 in respect to the chassis 3 since the robot 4 upon an exact positioning of the chassis 3 in respect to the workstation 10 consequently assumes its own exact position relative to said workstation 10.

The robot 4 when it is in its service position W, that is, its place of coaction with the textile machine 1, must be aligned exactly to the respective workstation 10 and the equipment and mechanisms thereof. This is true both in view of its position parallel to the running rails 14, 140, and also transverse thereto in horizontal and vertical directions. For this purpose the chassis 3 is equipped in the conventional way with arresting means which bring the chassis 3 exactly into position for the workstation 10 on the longitudinal running rails 14 and 140. The adjustment for height of the chassis as well as its horizontal alignment transverse to the longitudinal extension of the machine is made by means of an adjustment of the support rollers 32 and 320 along with the guide roller 34.

With the aid of the guide rods 35 and 350, the robot 4 is adjusted exactly in a longitudinal directions as well as a vertical direction to be precisely aligned in respect to the workstation 10 of the textile machine 1. The corresponding friction between the coacting guide elements (guide rods 35 and 350 on the one side and guide pieces 40 and 41 otherwise) is sufficient to secure the robot 4 in its exact operational, i.e. service position W, in relation to the workstation 10. This assures that the distance of the robot 4 from the workstation 10 is correct when the robot 4 assumes its position in its service or operational position W. Since the robot 4 is obliged to leave its operational position W for an inspection only at relatively extended time intervals, such friction is entirely acceptable particularly in that this friction can be reduced in an increasing measure by the use of appropriate choices of material for the contacting slide surfaces. Additionally, the friction between the robot 4 and the chassis 3 can be reduced by appropriate shaping of the guide elements (guide rods 35 and 350 on the one hand and guide pieces 40 and 41 on the other).

In accord with the embodiment shown in FIG. 1 per guide rod 35 and 350 there is respectively provided one locking mechanism 36 or 360 which secures the robot 4 in its service or operational position W. If the robot 4 is to be brought out of its operational position W into its inspection position I (double arrow $f_2$), then the locking mechanisms 36 and 360 are activated for the release of the robot 4. The locking mechanisms 36 or 360 and their device for activation of release can be made in the usual conventional manner and are on this account not described in detail.

The locking mechanisms 36 and 360 can be adjustable in order, by new adjustments of the chassis in relation to the textile machine, to compensate for possible distance changes which may occur between the robot 4 and the workstation 10.

Especially in the case in which the robot 4 is locked in its operational position W in relation to the chassis by another locking device 26, 260 measures can be provided for a reduction of the friction which eases the work of the operating person in bringing the robot out of its operational position W into its inspection position I and back again (double arrow $f_2$).

In accord with the embodiment shown in FIG. 2, the robot possesses a limit switch 43 of such a kind that it is activated when the robot 4 reaches its operational and service position W in a faultless fashion. Should this not be case then by means of a not depicted signal apparatus, a corresponding acoustic signal and/or an optical signal is released. In the same manner, the inspection position I of the robot 4 can be equipped with a like limit switch (not shown) which controllably stands in electrical connection with the corresponding acoustic signal and/or an optical signal (not shown).

In case a locking device 36, 360 is provided then this device is so advantageously designed that it automatically locks up when the robot 4 assumes its operational position W in a faultless manner. On this basis, the limit switch 43 can also be assigned to the locking device 36 or 360 and release an alarm if the locking device 36, 360 comes into its position in a faulty manner.

Upkeep work on the robot 4 itself, as a rule, takes only a limited amount of time so that the assigned service stretch along the workstations 10 of the textile machine 1 which are thereby excluded from service from a maintenance carriage are neglected only for a brief time and to this extent cannot be serviced.

Although these service outfall-times are relatively short and consequently within this period only a few service calls occur, an improvement in the situation can be brought about in that servicing operations which are foreseeable, that is the predictable incidence of spool exchange, cleaning operations of the work places 120 and their mechanisms, etc. are pre-scheduled and carried out even before the dropping out of a maintenance carriage, this work being done by this concerned carriage or another carriage 2. Possibly, the maintenance carriage 2 which is to be inspected can be brought temporarily into one of the running rail extensions 15, 150, so that the servicing operation procedures can be carried out by another maintenance carriage 2 before the maintenance carriage 2 which is to be inspected, is returned to its position in front of the concerned workstation 10.

Should for any reasons such as an especially thorough maintenance operation or a complete rebuild be necessary or advantageous for the robot 4 to be taken out of service for a substantial period, then as a rule this is not carried out by bringing the robot 4 into its inspection position I. Much more likely, the robot 4 would be entirely removed from the textile machine 1. Principally, this can be done also with the removal of the chassis 3. The design of the maintenance carriage 2 as a two-part apparatus forms, however, a precondition for an assembly which enables the removal of only the robot 4 by lifting from the textile machine 1 instead of the entire maintenance carriage 2. If this is done the faulty robot 4 must be replaced by another robot 4 even if this is only temporary. In this way, the maintenance carriage 2 is once again ready for service after only a short interruption.

The robot 4 possesses on its side proximal to the textile machine corresponding openings (not shown) through which, normally, the guide rods 35 and 350 extend into the interior of the robot 4. Upon removal, the robot 4 is worked out by axial movements (double arrow $f_2$) until it is free of the length of the guide rods 35 and 350 and can be taken away. It is obvious that the securement means (not shown) in the form of slide detents 37 and 370 are in place. These secure respectively guide rods 35 and 350 and prevent an accidental sliding away of the robot from the textile machine 1 to beyond the inspection position. Such a movement is allowable only after the detents are released. Functioning as designed sliding detents 37 and 370, these securement means advantageously define the inspection position I of the robot 4.

The described apparatus can be altered in many ways without exceeding the framework of the invention. Especially, this can entail the exchange of single features by equivalents or even other combinations of the features and/or their equivalents. Thus, it can be sufficient to provide respectively only a single locking means and/or a single sliding detent, for instance, dependent upon the special design and/or arrangement of the locking device 36 and/or 360, as well as upon that of the sliding detent 37 and/or 370.

The rotor 4, as a rule must be moved not too often out of the service position W into the inspection position I and back again into the operational and service position W (double arrow $f_2$). Consequently, for the guidance of the robot 4 during this movement in relation to the chassis 3, a sliding motion will suffice as has been explained in the example of the guide rods 35 and 350 as well as the guide pieces 40 and 41. In this way, the robot 4 because of the friction between the guide rods 35 and 350 on the one hand and the guide pieces 40 and 41 on the other is secured in movement relative to the chassis 3 so that the locking mechanisms 36 and 360 and the slide blocks 37 and 370 under some circumstances could be dispensed with, or could be built less powerful as in the case (which is likewise a possibility) when the robot 4 with the aid of rollers (not shown) is installed to be movable on the chassis 3.

As has already been indicated above, it is also possible to assign to the two mobile maintenance carriages, i.e. 2*a* and 2*b*, (FIG. 1) a respectively fixed service stretch on one longitudinal side of the textile machine 1. Further, this stretch could be changed when one of the two maintenance carriages 2*a* or 2*b* is taken out of service by moving its robot 4 into the inspection position I.

When contrary to the above description for a pair of maintenance carriages 2*a*, 2*b*, 2*c*, or 2*d* (or more not further indicated here) on, respectively one machine side A or B, no fixed service stretch has been determined, then the limit switch 43 or a corresponding other limit switch could serve dependent upon the out-of-service maintenance carriage 2, to add the neglected service stretch thereof to the normal service stretch of another currently working maintenance carriage 2. This will be explained in the following.

The maintenance carriages 2*a*, 2*b*, as well as if so provided, 2*c*, 2*d*, remain in communication with the control center 5 (FIG. 1) in the conventional manner by the already mentioned data transmission or control lines 50. Also connected through this data and/or control line 50 to the control center 5 is the limit switch (except with the mentioned but not shown acoustic and/or optical alarm device). This control center 5 is programmed, so that dependent as to whether or not the robot 4 of a maintenance carriage 2 is either in or out of service, the assigned extent of the service stretch for the maintenance carriage 2 which remains in service is fixed.

In accord with FIG. 1, with such a design, the control center 5 and the limit switch 43 (FIG. 2) of the maintenance carriage (for instance) 2*a* are activated because upon the withdrawal of the robot 4 from its service position W the limit switch 43 is released. Limit switch 43 is activated by the robot 4 when this reaches the inspection position I. Now, through the control center 5 the maintenance carriage 2*b* remaining in service (on that same side) extends its already active service stretch to take over the stretch of the not-in-service maintenance carriage 2*a*. This situation endures until a corresponding activation of the limit switch 43 of carriage 2*a* occurs or another limit switch (not shown) acts. Either switch evokes a signal from control center 5, that the previously out-of-service maintenance carriage 2*a* has once again reached its operational position W.

Thereupon, the work stretch of the maintenance carriage 2*b* is reduced to its originally assigned limits.

If on one longitudinal machine side A or B, more than two maintenance carriages 2 are provided, then the service stretch of an out-of-service maintenance carriage 2 can be subdivided for the attention of two (or a plurality of) other maintenance carriages 2 for which arrangement it is necessary to input a suitable program into the control center 5.

Instead of the aid of guide rods 35, 350 and guide pieces (rollers) 40, 41, naturally a different guidances can be provided. Among these could be a spring working in a groove (somewhat of the order of a swallow tail guide) or a guide groove in which rollers were run, or the like. Alternatively, the robot 4 can also be fixed upon the chassis 3 by means of rods (not shown) and be movable relative to said rods. Also, in such a case between the chassis 3 and the robot 4 a releasable connection could be provided so that in case of need, the robot 4 for its own maintenance or for exchange could be independent of the chassis 3 and be disconnected therefrom. It should be appreciated by those skilled in the art that various modifications and variations can be made in the present invention without departing from the spirit and scope of the invention.

What is claimed is:

1. An apparatus for servicing a textile machine, comprising:

a mobile maintenance carriage which travels over rails along a plurality of work stations of the textile machine for performing a service function at the work stations, said maintenance carriage further comprising:

A a mobile chassis configured for traveling on the rails alongside the work stations; and a robot configured on said chassis, said robot movable on said chassis in a direction towards and away from the work stations that is generally perpendicular to the direction of travel of said mobile chassis wherein said chassis comprises guide structure extending in a direction transverse to the direction of travel of said chassis, said robot being movable along said guide structure.

2. The apparatus as in claim 1, wherein said robot is movable on said chassis to a distance of at least 40 cm away from the textile machine work station so as to define a passageway between said robot and the textile machine.

3. The apparatus as in claim 1, wherein said robot is movable on said chassis to a distance of about 50 cm away from the textile machine work station so as to define a passageway between said robot and the textile machine.

4. The apparatus as in claim 1, wherein said guide structure comprises at least two guide rods extending in a direction transverse to the direction of travel of said chassis, said robot movable along said guide rods.

5. The apparatus as in claim 4, wherein said robot is slidably mounted on said guide rods.

6. The apparatus as in claim 5, wherein said robot comprises guide pieces slidably engaged with said guide rods, at least one said guide piece disposed below said guide rods and at least one said guide piece disposed above said guide rod.

7. The apparatus as in claim 1, wherein said robot is removable from said chassis.

8. The apparatus as in claim 7, further comprising a locking device configured to secure said robot to said chassis.

* * * * *